US008087665B2

(12) United States Patent
Hirai

(10) Patent No.: US 8,087,665 B2
(45) Date of Patent: Jan. 3, 2012

(54) SHEET CONVEYING APPARATUS AND IMAGE FORMING APPARATUS WITH MOVABLE UNIT AT A BRANCH POSITION

(75) Inventor: Ko Hirai, Toride (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 12/479,296

(22) Filed: Jun. 5, 2009

(65) Prior Publication Data

US 2009/0302524 A1 Dec. 10, 2009

(30) Foreign Application Priority Data

Jun. 6, 2008 (JP) ..... 2008-149456

(51) Int. Cl.
*B65H 29/00* (2006.01)

(52) U.S. Cl. ..... 271/186; 271/303; 271/304; 271/902

(58) Field of Classification Search ..... None
See application file for complete search history.

(56) References Cited

U.S. PATENT DOCUMENTS 6,460,847 B1 * 10/2002 Boss ..... 271/225
6,478,490 B2 * 11/2002 Kelley et al. ..... 271/186

* cited by examiner

*Primary Examiner* — Gerald McClain
(74) *Attorney, Agent, or Firm* — Rossi, Kimms & McDowell LLP

(57) ABSTRACT

A sheet conveying apparatus includes a first conveying path through which a sheet is conveyed; a reversal conveyance driving unit which drives to reversely convey the sheet conveyed through the first conveying path; a second conveying path which branches off with the first conveying path and through which the sheet reversely conveyed by the reversal conveyance driving unit is conveyed; and a movable unit which causes a branch position between the first conveying path and the second conveying path to move on a downstream side in a conveying direction of the sheet which is conveyed through the first conveying path, after a trailing end of the sheet which is conveyed through the first conveying path passes the movable unit.

10 Claims, 13 Drawing Sheets

SHEET CONVEYING APPARATUS AND IMAGE FORMING APPARATUS WITH MOVABLE UNIT AT A BRANCH POSITION

BACKGROUND OF THE INVENTION

1. Field of the Invention

The present invention relates to a sheet conveying apparatus that conveys sheets and an image forming apparatus such as a copying machine or a printer that uses the sheet conveying apparatus.

2. Description of Related Art

An example of a conventional sheet conveying apparatus is illustrated in FIG. 13. The sheet conveying apparatus reverses a sheet having an image formed on one side thereof, to discharge (back-side discharge) the sheet with the image side face down. Such discharging is performed to maintain the proper page order of sheets having images formed thereon.

Specifically, a conveying path is switched by a first switching member 24 rotating to a predetermined position and a sheet having an image fixed on the top side thereof by a fixer is conveyed to a first reversal path 51. The sheet is then caused to pass through a gate 53 where a flexible material 53S is provided, by a pair of carry-in rollers 52 and is conveyed to a second reversal path 54.

In this case, the sheet causes the flexible member 53S to bend by its toughness to pass through the gate 53. The flexible member 53S is affixed at its one end to the gate 53 and abuts at its other end on a guide plate 54G which composes the second reversal path 54.

Then, the conveying path is switched by rotating a second switching member 56 to a predetermined position and the sheet is conveyed to a third reversal path 57.

The sheet is further conveyed by a reversal roller 58 until a sheet trailing end reaches a reversal point A. The reversal roller 58 stops after a lapse of a predetermined period of time from when a reversal sensor 55 detects the sheet trailing end. The reversal roller 58 is driven by a forward/reverse rotatable stepping motor (not illustrated).

Thereafter, the reversal roller 58 is reversely rotated. At this time, a sheet leading end in a reversal direction is prevented from returning to the first reversal path 51 by the flexible member 53S affixed to the gate 53. The sheet passes through a pair of discharge rollers 59 and is discharged onto a discharge tray 27 by a pair of outer discharge rollers 26. By this, sheets are stacked on the discharge tray 27 with their image sides face down (see Japanese Patent Application Laid-Open No. 10-139248).

In Japanese Patent Application Laid-Open No. 10-139248, an image side of a subsequent sheet rubs against a previous sheet. In the sheet conveying apparatus, a sheet has been just fixed and thus it is highly likely that an image is not sufficiently dried. If the image side of the sheet is rubbed in such a state, the image may be significantly degraded.

SUMMARY OF THE INVENTION

The present invention provides a sheet conveying apparatus including a reversal unit and an image forming apparatus that can achieve an increase in speed without causing image degradation.

A sheet conveying apparatus of the present invention includes a first conveying path through which a sheet is conveyed; a reversal conveyance driving unit which drives to reversely convey the sheet conveyed through the first conveying path; a second conveying path which branches off with the first conveying path and through which the sheet reversely conveyed by the reversal conveyance driving unit is conveyed; and a movable unit which causes a branch position between the first conveying path and the second conveying path to move on a downstream side in a conveying direction of the sheet which is conveyed through the first conveying path, after a trailing end of the sheet which is conveyed through the first conveying path passes the movable unit.

According to the present invention, in continuous printing, while the intervals between sheets are reduced, rubbing caused by a previous sheet and a subsequent sheet rubbing against each other can be prevented.

Further features of the present invention will become apparent from the following description of exemplary embodiments (with reference to the attached drawings).

DESCRIPTION OF THE EMBODIMENTS

Figure 1:
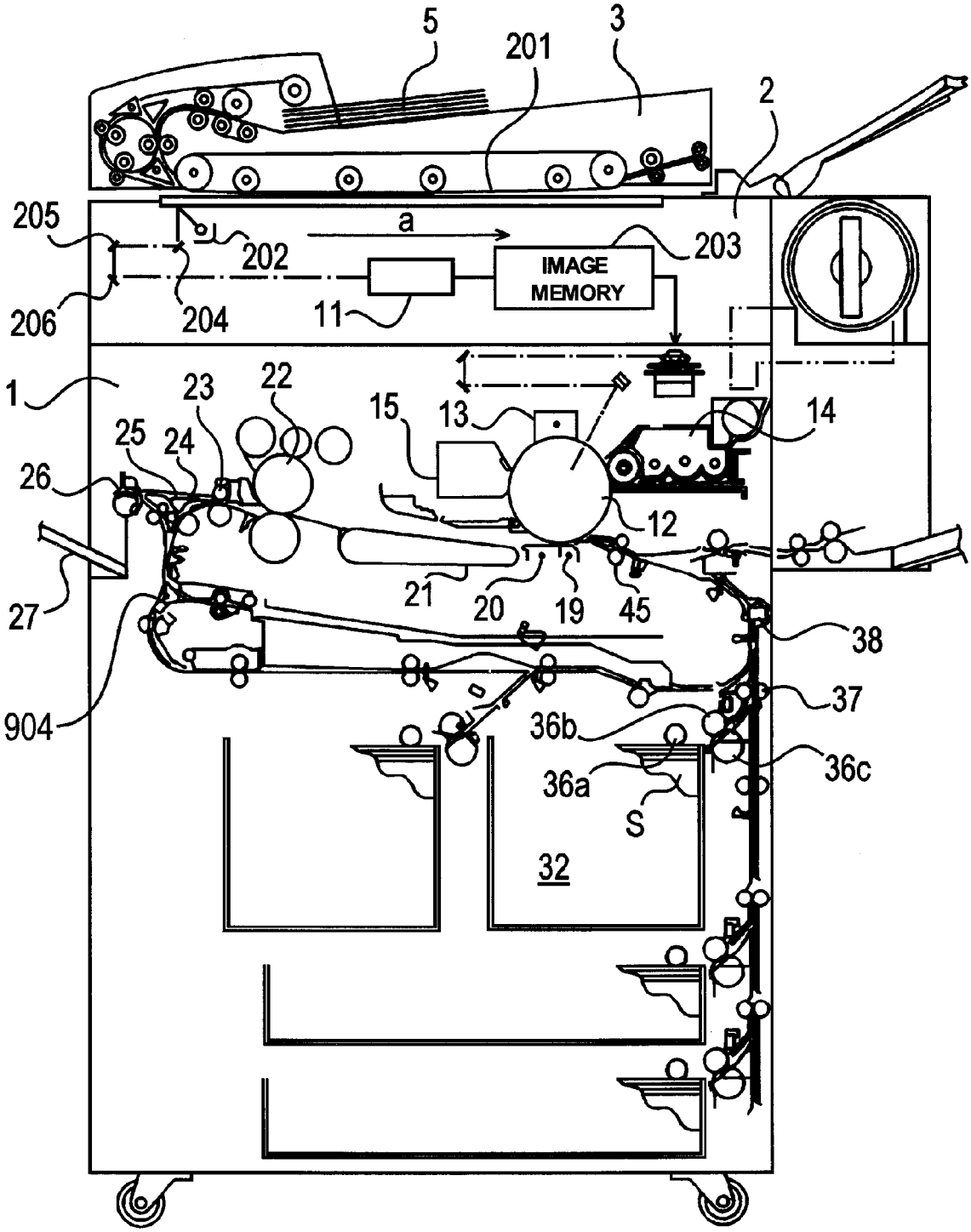
FIG. 1 is a vertical cross-sectional view illustrating a configuration of an image forming apparatus according to one embodiment of the present invention.

An embodiment of the present invention will be described in detail below based on the drawings. FIG. 1 is vertical cross-sectional view illustrating an example in which a sheet conveying apparatus according to one embodiment of the present invention is applied to a printer.

In FIG. 1, a printer body 1 is provided on its top with an automatic document feeding apparatus 3 that can continuously convey documents 5 to a reading unit 2.

An original base plate 201 is made of a transparent glass plate and is fixedly provided. The original base plate 201 fixes a document 5 fed by the automatic document feeding apparatus 3, in a predetermined position thereof with an image side face down. Below the original base plate 201 is provided an optical system including a lamp 202 that illuminates a document 5; reflecting mirrors 204, 205, and 206 for guiding an optical image of the illuminated document 5 to an image memory unit 203; and an image-forming lens 11. The lamp 202 and the reflecting mirrors 204, 205, and 206 move in an arrow "a" direction at a predetermined speed to scan the document 5.

An image forming unit includes a photosensitive drum 12 and a charger 13 for providing uniform charging on a surface of the photosensitive drum 12. The image forming unit further includes a development device 14 that develops an electrostatic latent image formed by an optical image irradiated from a scanner 8, on the surface of the photosensitive drum 12 charged by the charger 13, to form a toner image to be transferred onto a sheet S. Further, the image forming unit includes a transfer charger 19, a separating charger 20, and a cleaner 15.

The transfer charger 19 transfers the toner image developed on the surface of the photosensitive drum 12 onto a sheet S. The separating charger 20 separates the sheet S onto which the toner image is transferred, from the photosensitive drum 12. The cleaner 15 removes toner remaining on the photosensitive drum 12 after the toner image is transferred onto the sheet S.

When one side of a sheet S on a sheet tray 32 is printed and the sheet S is discharged with an image side face up, by pressing a start button (not illustrated), a sheet S is fed from the sheet tray 32 by sheet feeding rollers 36*a*, 36*b*, and 36*c*. The sheet S is then conveyed by pairs of conveying rollers 37 and 38, skew feeding of the sheet S is corrected by a pair of registration rollers 45, and the sheet S is conveyed to a transfer position of the image forming unit at predetermined timing.

On the downstream side of the image forming unit are provided a belt conveying unit 21 for conveying the sheet S having the toner image transferred thereonto; and a fixer 22 for fixing the image on the sheet S conveyed by the belt conveying unit 21 as a permanent image.

The sheet S whose image is fixed by the fixer 22 passes through a pair of inner discharge rollers 23 and is guided to a straight discharge conveying path 25 by a first switching member 24 and then is discharged from the printer body 1 by a pair of outer discharge rollers 26. A discharge tray 27 is provided outside the printer body 1 to receive the sheet S discharged by the pair of outer discharge rollers 26, whereby the copy completes. When a sheet S is discharged reversely, a sheet S having an image fixed thereon is guided to a reversal roller 904 serving as a reversal conveyance driving unit. The reversal roller 904 conveys the conveyed sheet S to draw the sheet S downward which is a first direction and then conveys the sheet S upward which is a second direction opposite to the first direction. The sheet S conveyed in an upward direction by the reversal roller 904 is discharged from the printer body 1 by the pair of outer discharge rollers 26. In the following, the conveyance of a sheet S in the first direction by the reversal roller 904 is referred to as the "drawing operation" and the conveyance in the second direction by the reversal roller 904 and the pair of outer discharge rollers 26 which are downstream rollers of the reversal roller 904 is referred to as the "reversal conveyance".

Figure 2:
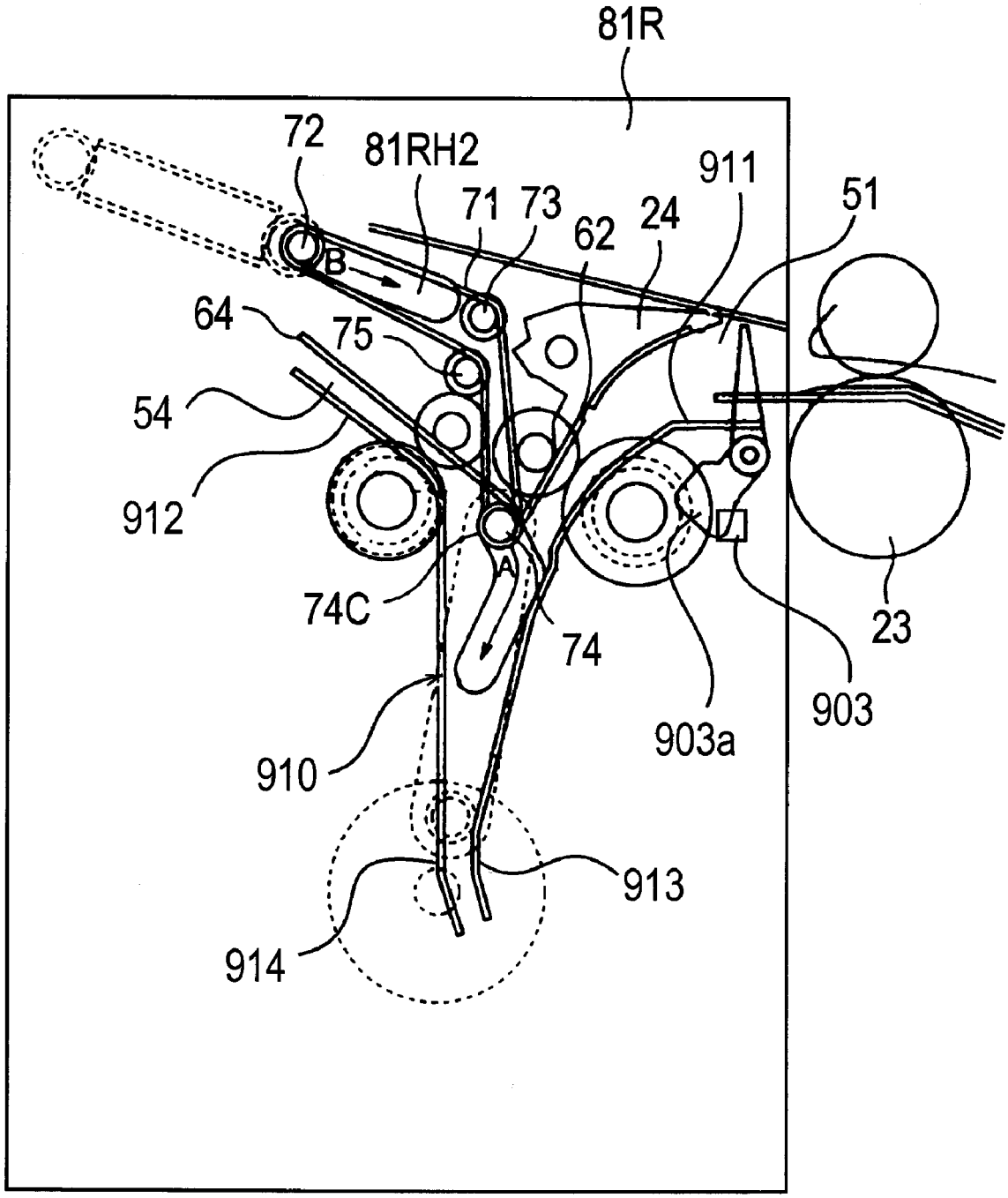
FIG. 2 is a cross-sectional view of a sheet conveying apparatus of the image forming apparatus illustrated in FIG. 1.

Next, a configuration of the sheet conveying apparatus will be described. FIG. 2 is a cross-sectional view of the sheet conveying apparatus and FIGS. 3 and 4 are perspective views of the sheet conveying apparatus.

In FIG. 2, a first sheet conveying path 51 is formed by a reversal middle right guide 62 and a first lower guide 911. A reversal conveying path 910 to which a sheet having passed through the first sheet conveying path 51 is conveyed and where the reversal roller 904 (see FIG. 1) is provided, is formed by a reversal right guide 913 and a reversal left guide 914. A second sheet conveying path 54 to which the sheet having passed through the reversal conveying path 910 is conveyed is formed by a reversal middle left guide 64 and a second lower guide 912.

On the inner side of the reversal middle right guide 62 forming the first sheet conveying path 51 and the reversal middle left guide 64 forming the second sheet conveying path 54, a plurality of belts 71 are hung on fixed shafts 73 and 75 and movable shafts (guide members) 72 and 74. The belts 71 are made of a flexible material, e.g., a PET film. The movable shaft 74 is a connecting portion between the first sheet conveying path 51 and the second sheet conveying path 54 and is movable at an upper portion of the reversal conveying path 910.

Figure 3:
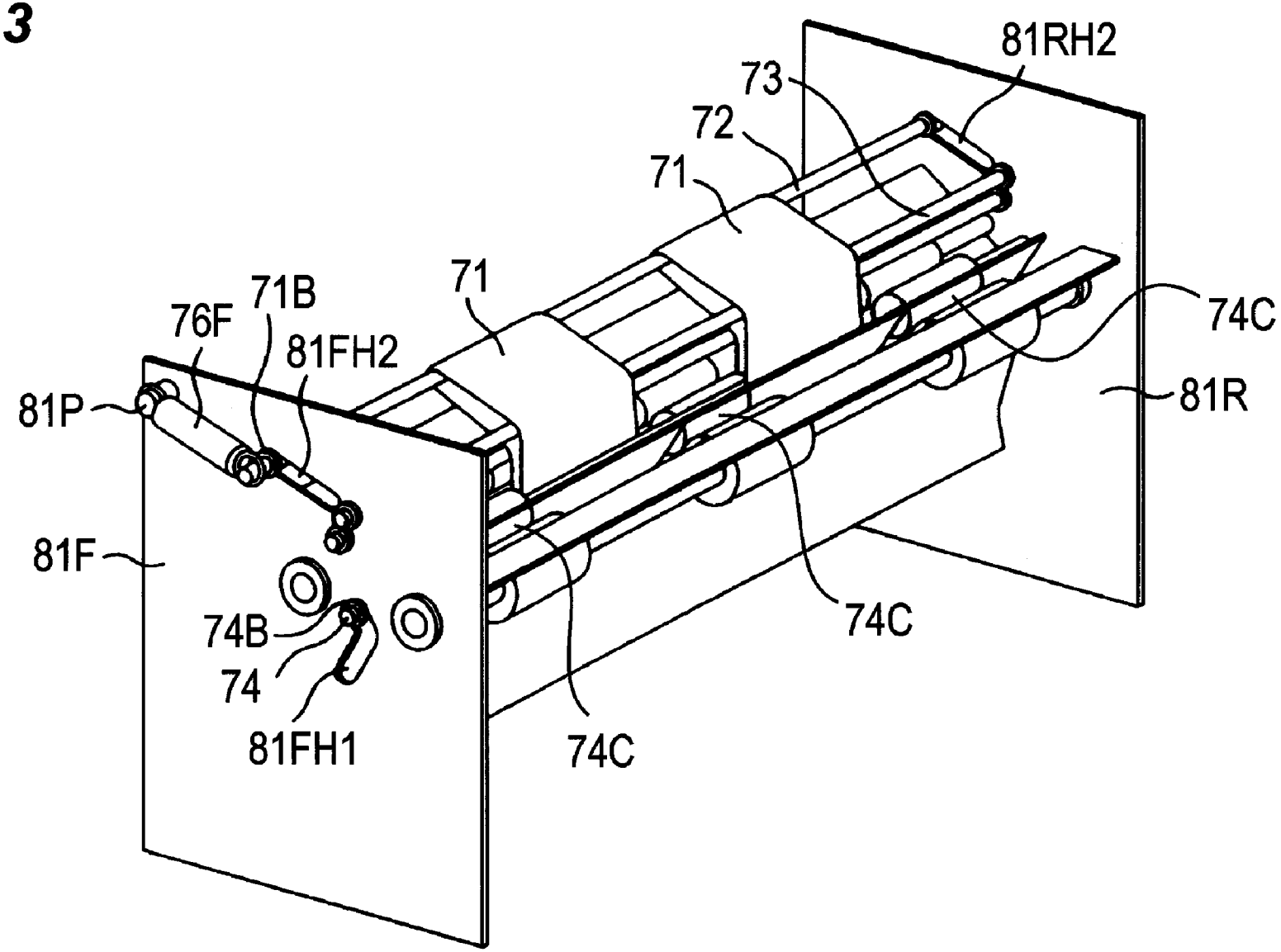
FIG. 3 is a perspective view of the sheet conveying apparatus of the image forming apparatus illustrated in FIG. 1.
Figure 4:
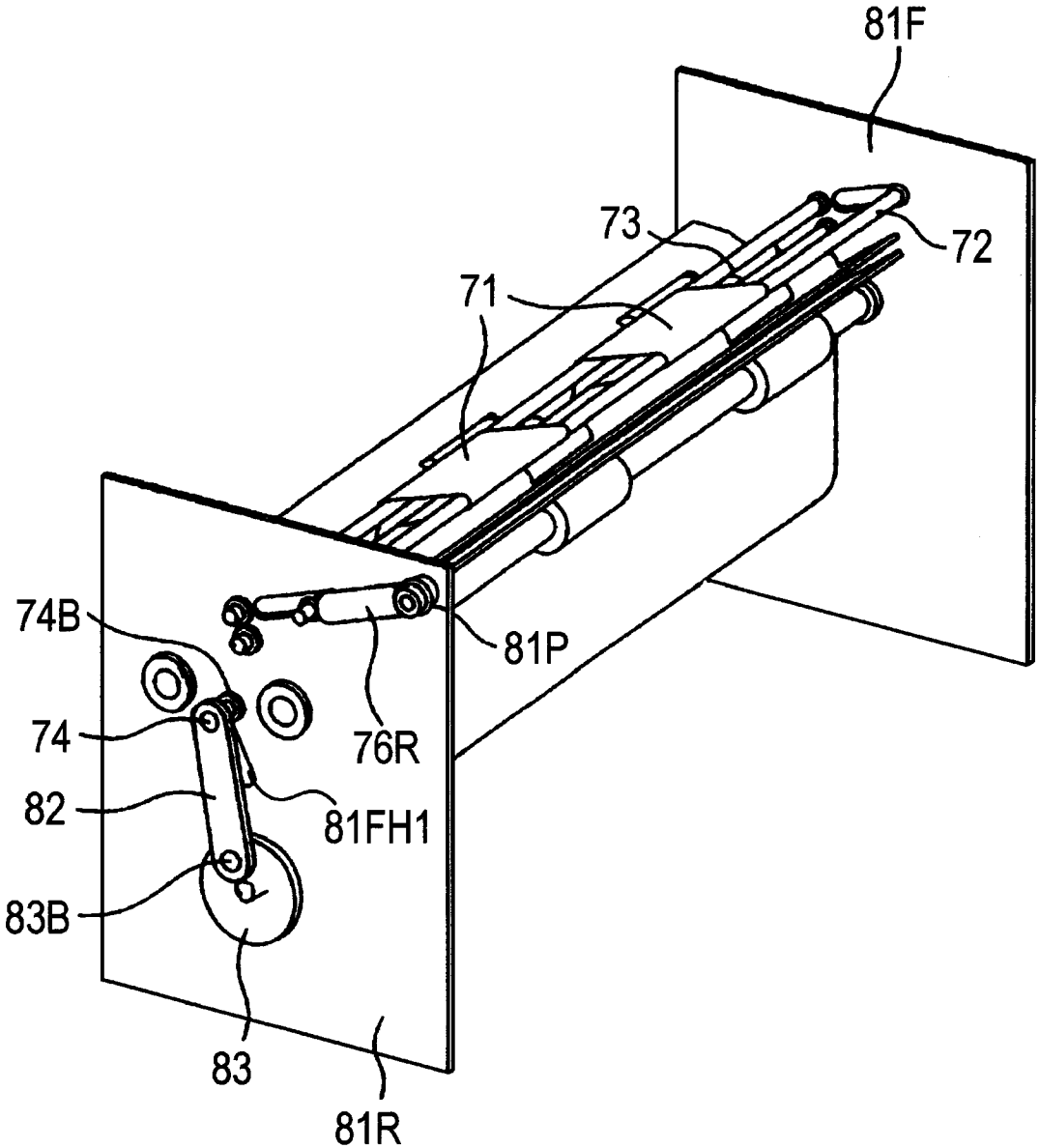
FIG. 4 is a perspective view of the sheet conveying apparatus of the image forming apparatus illustrated in FIG. 1.

As illustrated in FIGS. 3 and 4, the movable shaft 74 is disposed between frames 81F and 81R and is supported by bearings 74B at both ends thereof. A plurality of rollers 74C which are rotating members are coaxially arranged on the movable shaft 74. The plurality of rollers 74C have such outer dimensions that are larger in width dimension than the width dimension of the belts 71 by the order of 1 mm. The rollers 74C and the belts 71 are alternately arranged in a line in an axial direction of the movable shaft 74. The movable shaft 74 is movable in an arrow "A" direction through the bearings 74B along reverse C-shaped grooves 81FH1 and 81RH1 which are respectively provided to the frames 81F and 81R.

Similarly, the movable shaft 72 is also movable in an arrow "B" direction through bearings 71B along grooves 81FH2 and 81RH2 which are respectively provided to the frames 81F and 81R. The movable shaft 72 is biased in a direction opposite to the arrow B by tension springs 76F and 76R. One ends of the respective tension springs 76F and 76R are supported by corresponding spring hook shafts 81P respectively provided to the frames 81F and 81R and the respective other ends are hooked to the movable shaft 72.

The movable shaft 74 is connected by an arm 82 to a drive gear 83 which has an engaging shaft 83B integrally formed therewith. The arm 82 is pivotably supported by the movable shaft 74 and the engaging shaft 83B.

Figure 12:
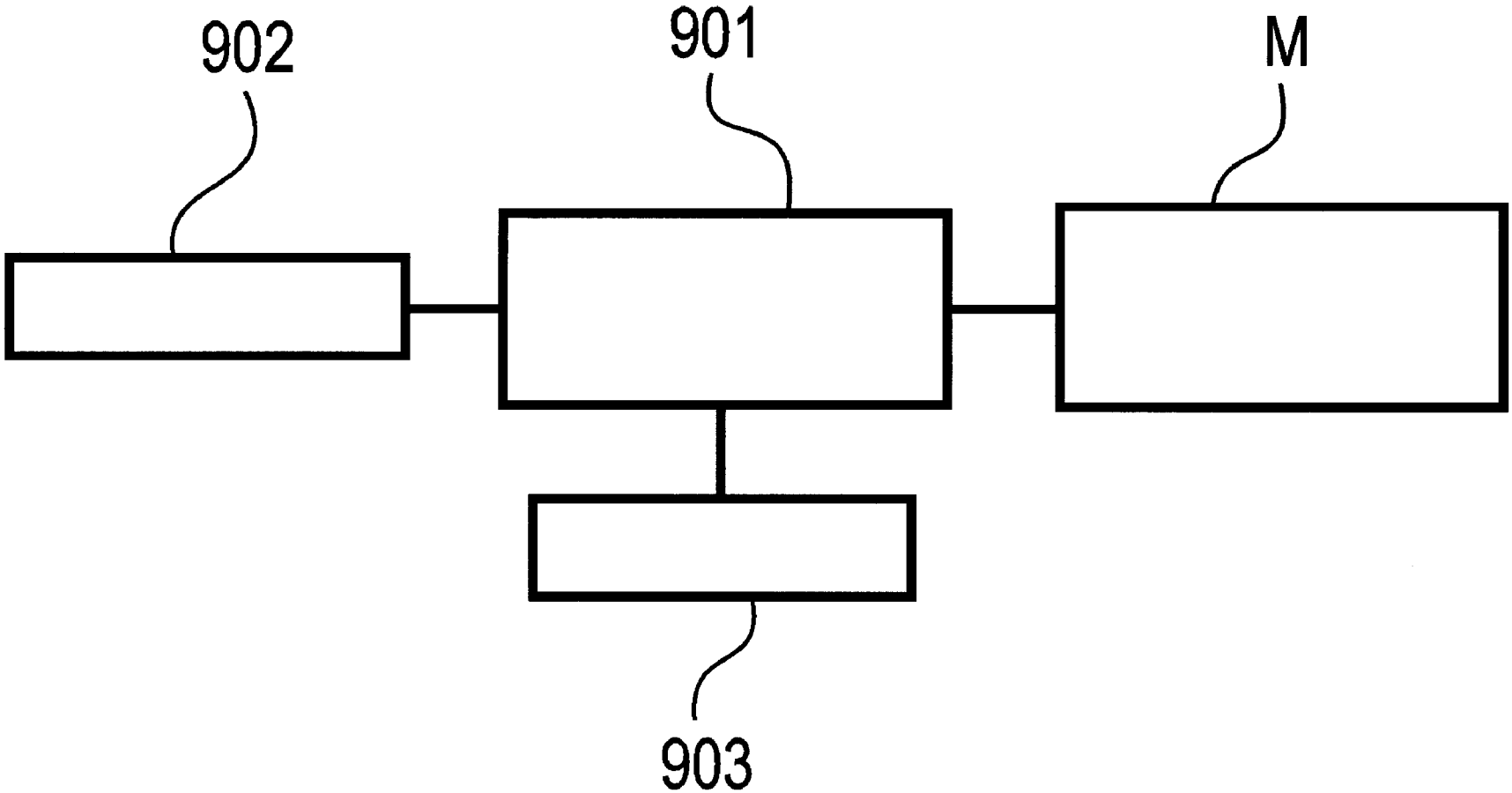
FIG. 12 is a block diagram of the sheet conveying apparatus.
Figure 13:
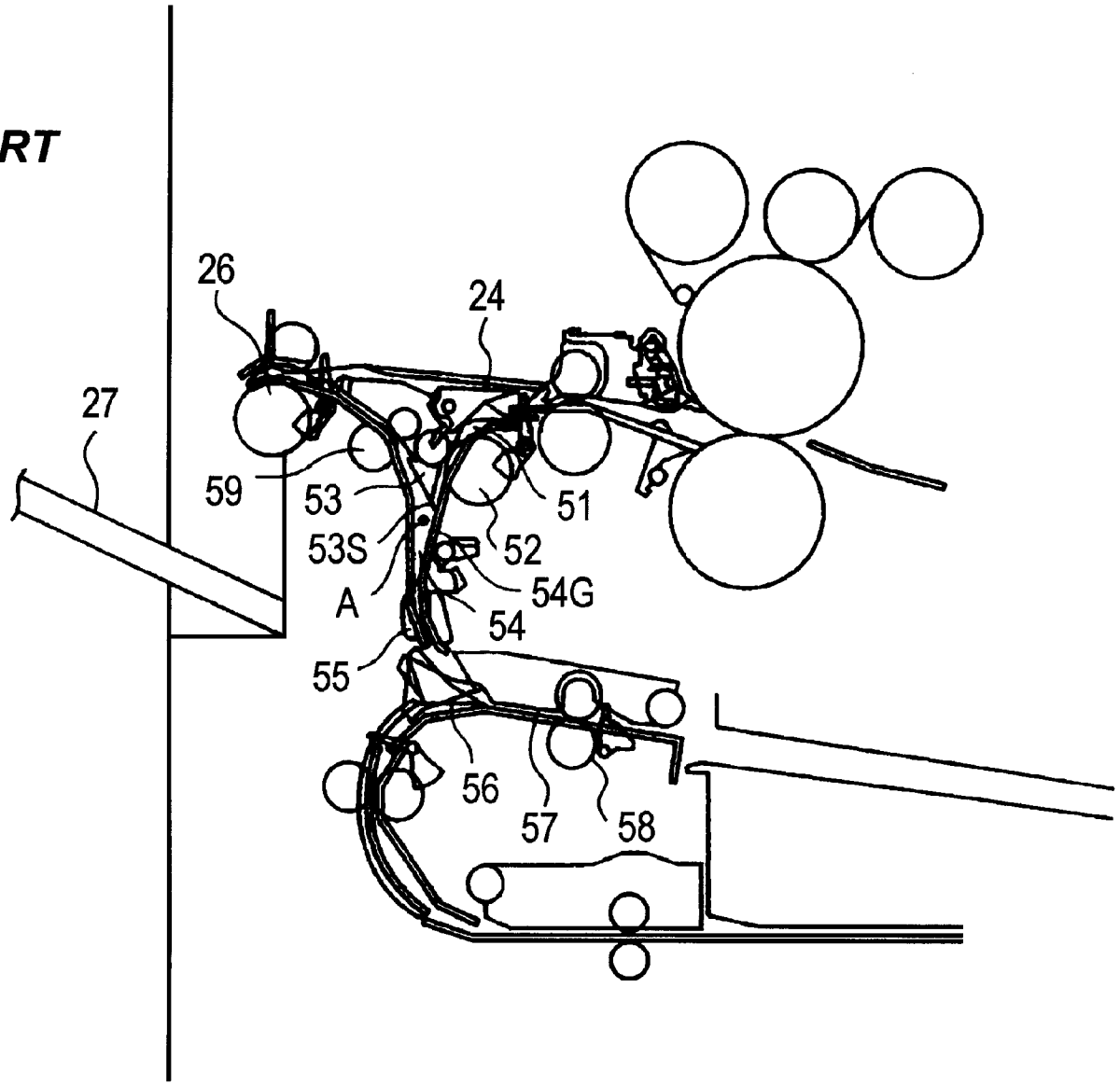
FIG. 13 PRIOR ART
FIG. 13 is a cross-sectional view of a conventional sheet conveying apparatus.

FIG. 12 is a block diagram of a control system for causing the movable shafts (guide members) 72 and 74 to move. A control unit 901 controls a stepping motor M connected to the drive gear 83, so that the rotation angle of the drive gear 83 can be controlled with high accuracy. An angle detection sensor 902 detects a phase angle of the drive gear 83. The control unit 901 recognizes a home position location of the drive gear 83 by an output from the angle detection sensor 902. A signal from an inner sheet discharge sensor 903 (see FIG. 2) is input to the control unit 901. As illustrated in FIG. 2, the inner sheet discharge sensor 903 detects a position of a flag which is moved by a sheet to be conveyed.

The operating positions of the movable shafts 72 and 74 for when a sheet is conveyed will be described below using FIGS. 5 to 10. First, in normal times or during printing of one copy, the movable shafts 72 and 74 are in a first position illustrated in FIGS. 5 and 6.

Figure 7:
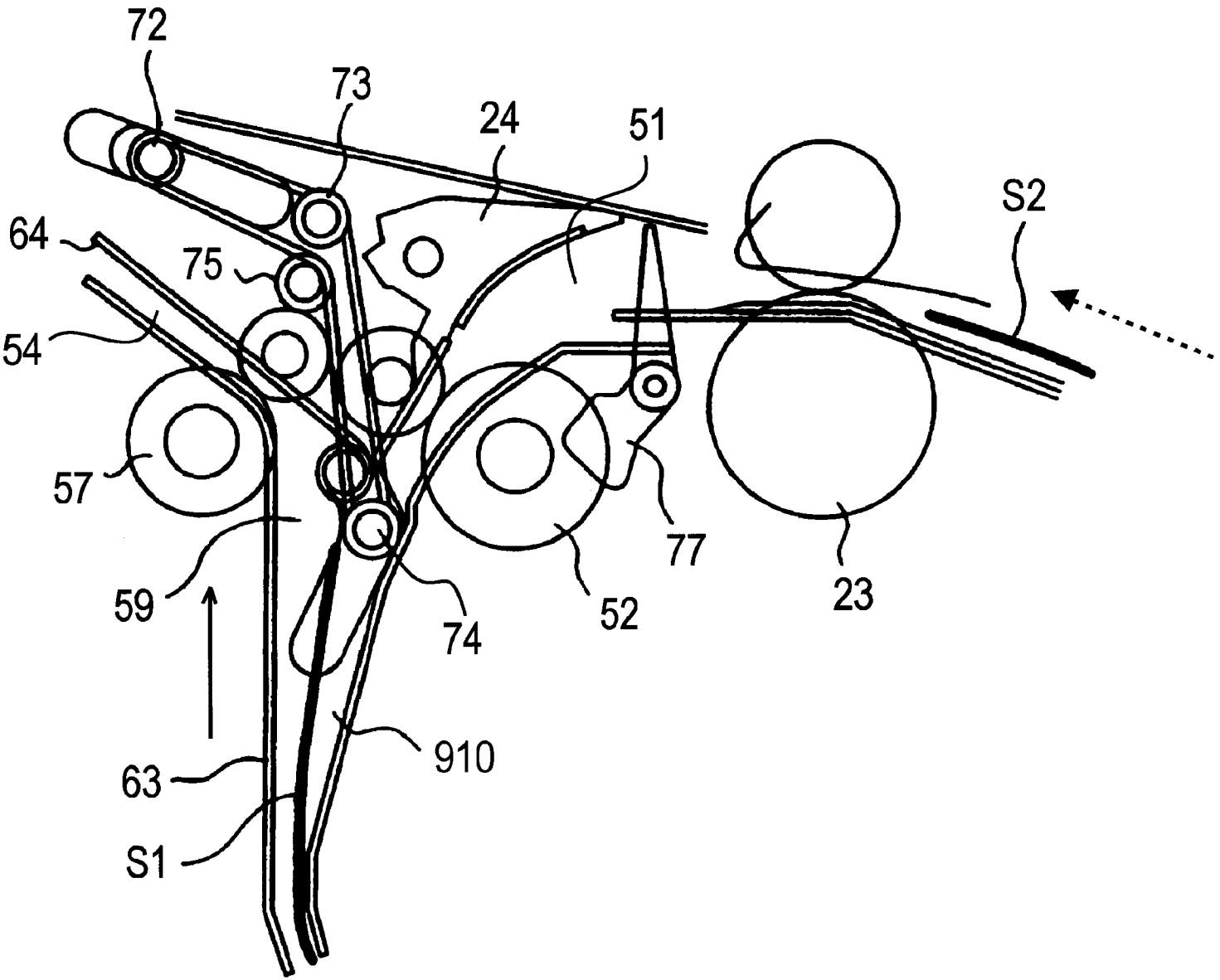
FIG. 7 is a cross-sectional view describing a sheet conveying state of the sheet conveying apparatus illustrated in FIG. 2.
Figure 8:
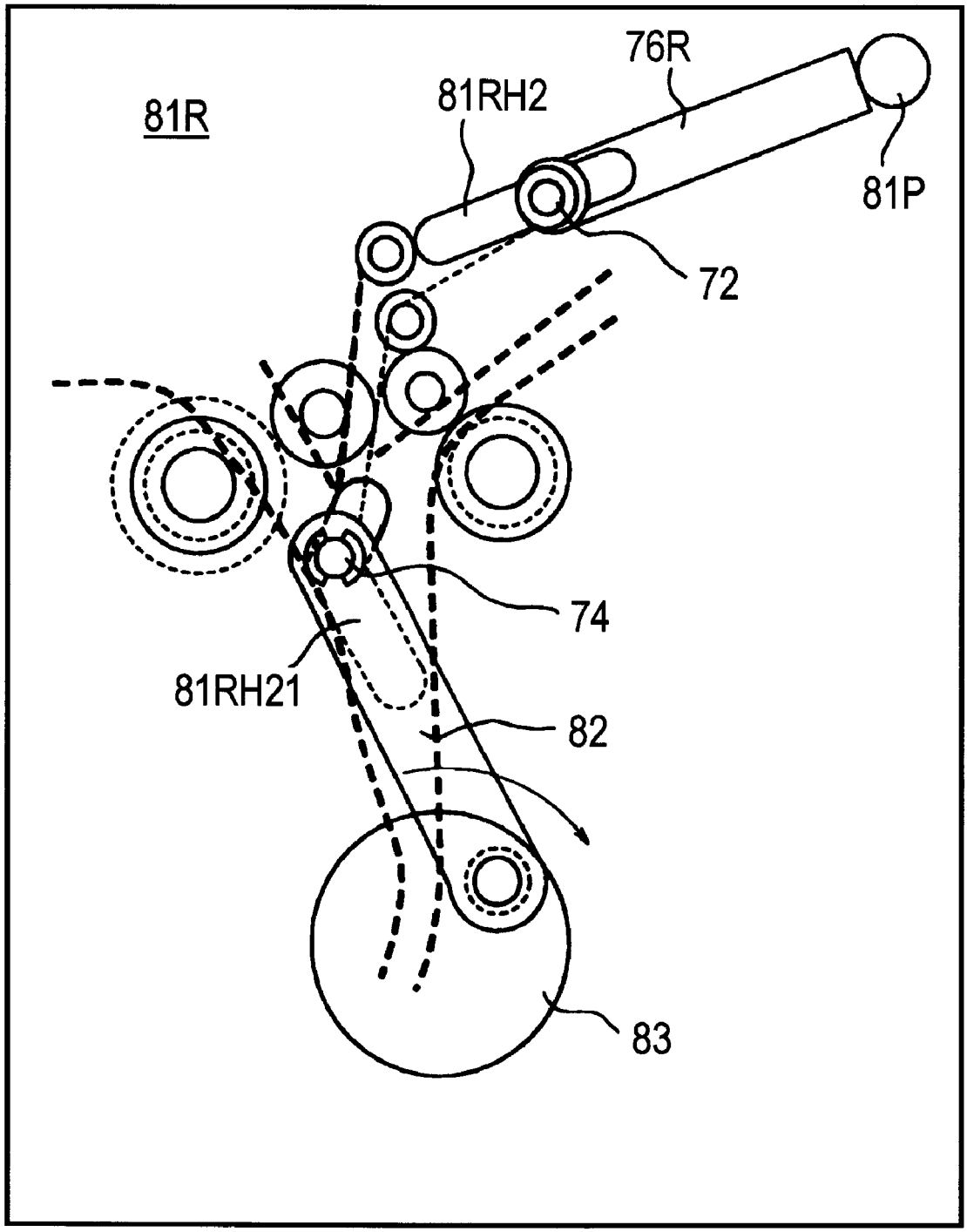
FIG. 8 is a cross-sectional view describing an operation of the sheet conveying apparatus illustrated in FIG. 2.

The control unit 901 controls the stepping motor M to cause the movable shafts 72 and 74 to move to a second position illustrated in FIGS. 7 and 8, during a period of time between when movement (drawing) of a sheet S1 in a forward direction stops and when conveyance (reversal conveyance) of the sheet S1 in a reverse direction starts. This prevents the sheet S1 from returning to the first sheet conveying path 51. That is, the movable shaft 74 acts as a return preventing unit.

Figure 5:
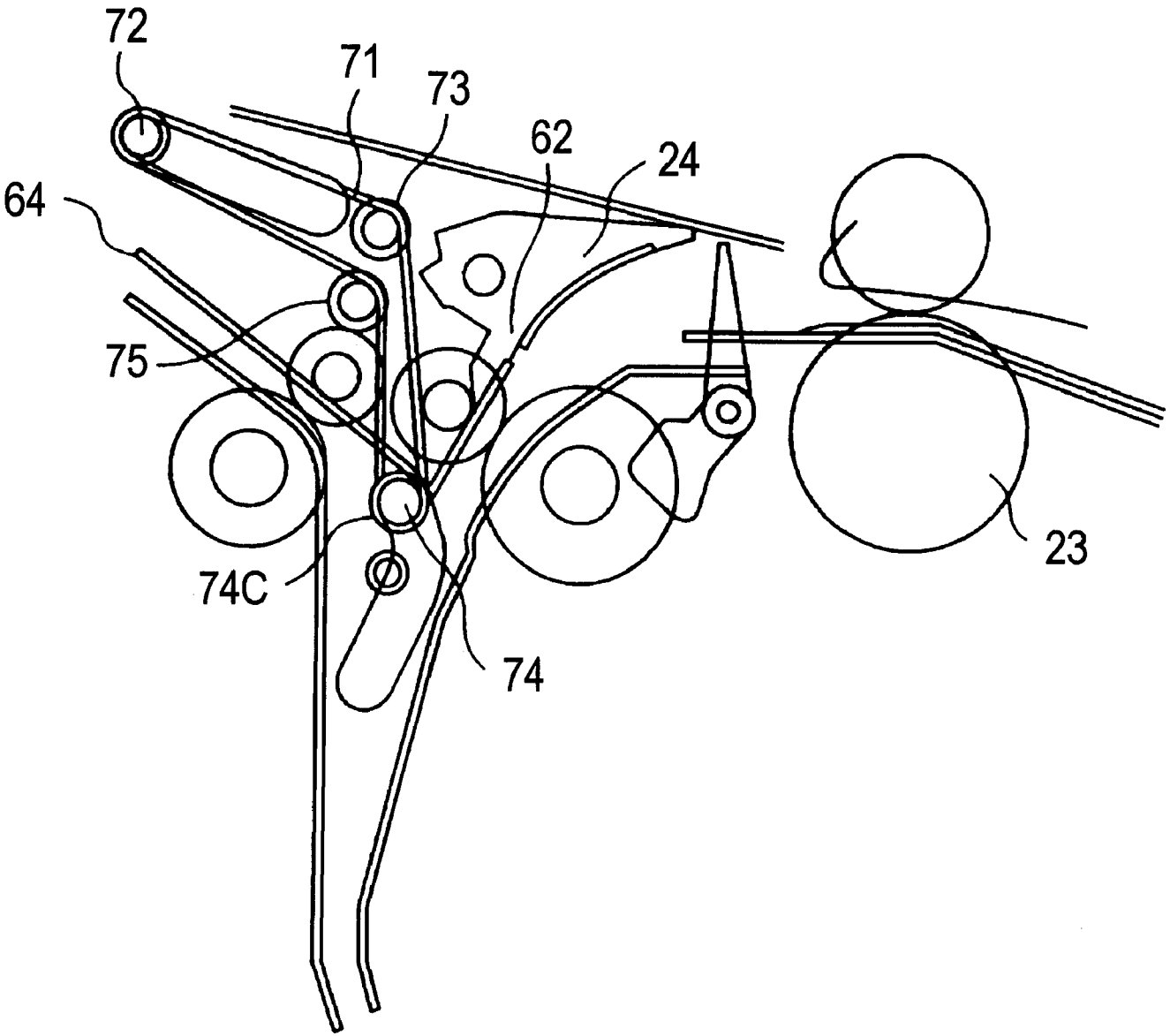
FIG. 5 is a cross-sectional view describing a sheet conveying state of the sheet conveying apparatus illustrated in FIG. 2.
Figure 6:
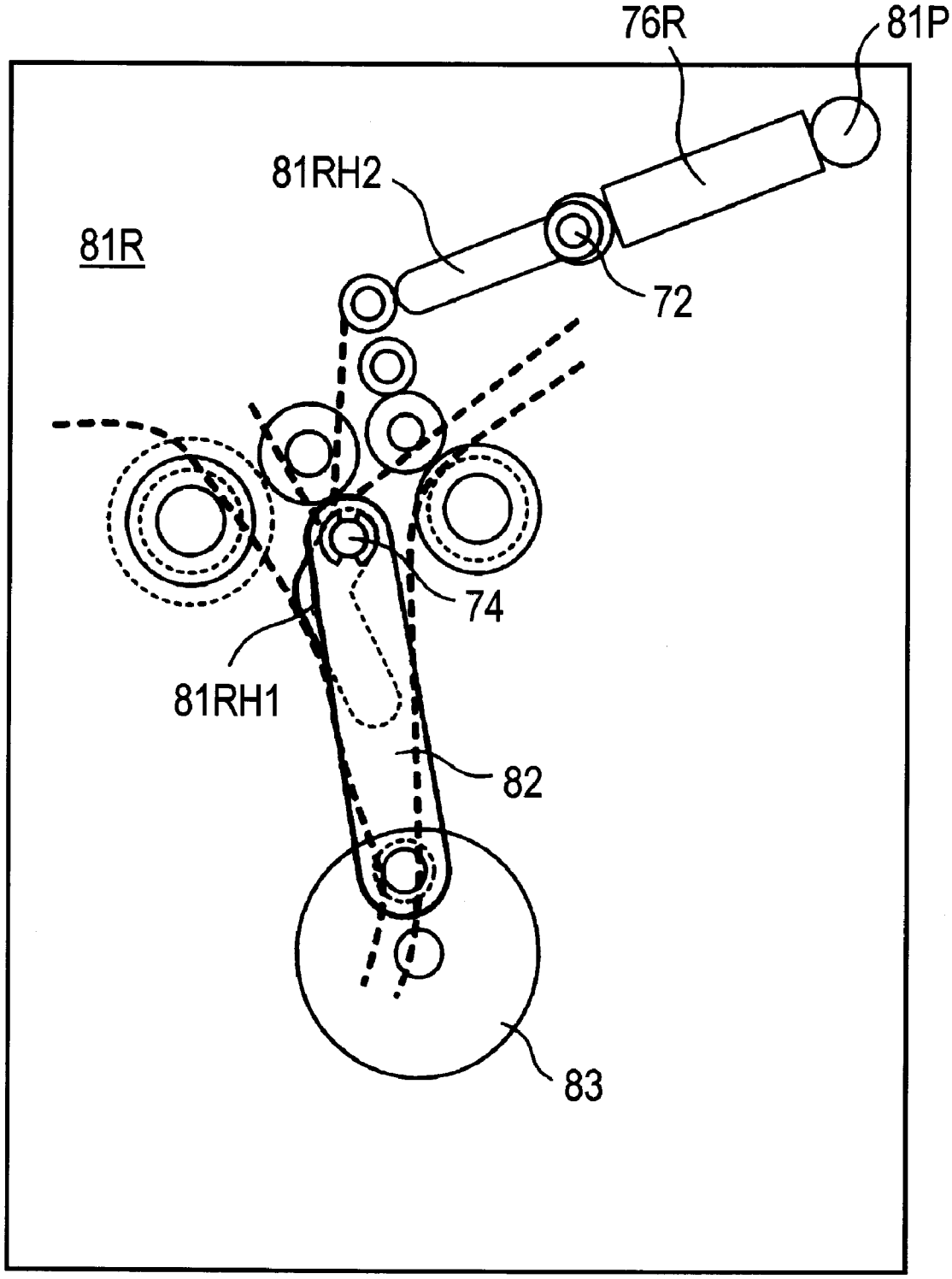
FIG. 6 is a cross-sectional view describing a sheet conveying state of the sheet conveying apparatus illustrated in FIG. 2.

Thereafter, the control unit 901 controls the stepping motor M to return the movable shafts 72 and 74 to the first position illustrated in FIGS. 5 and 6, after a previous sheet's leading end passes through a junction location. Here, in order to stop the movable shaft 74 in a predetermined position, the drive gear 83 is rotated by the stepping motor M by a predetermined step angle from a home position.

Figure 9:
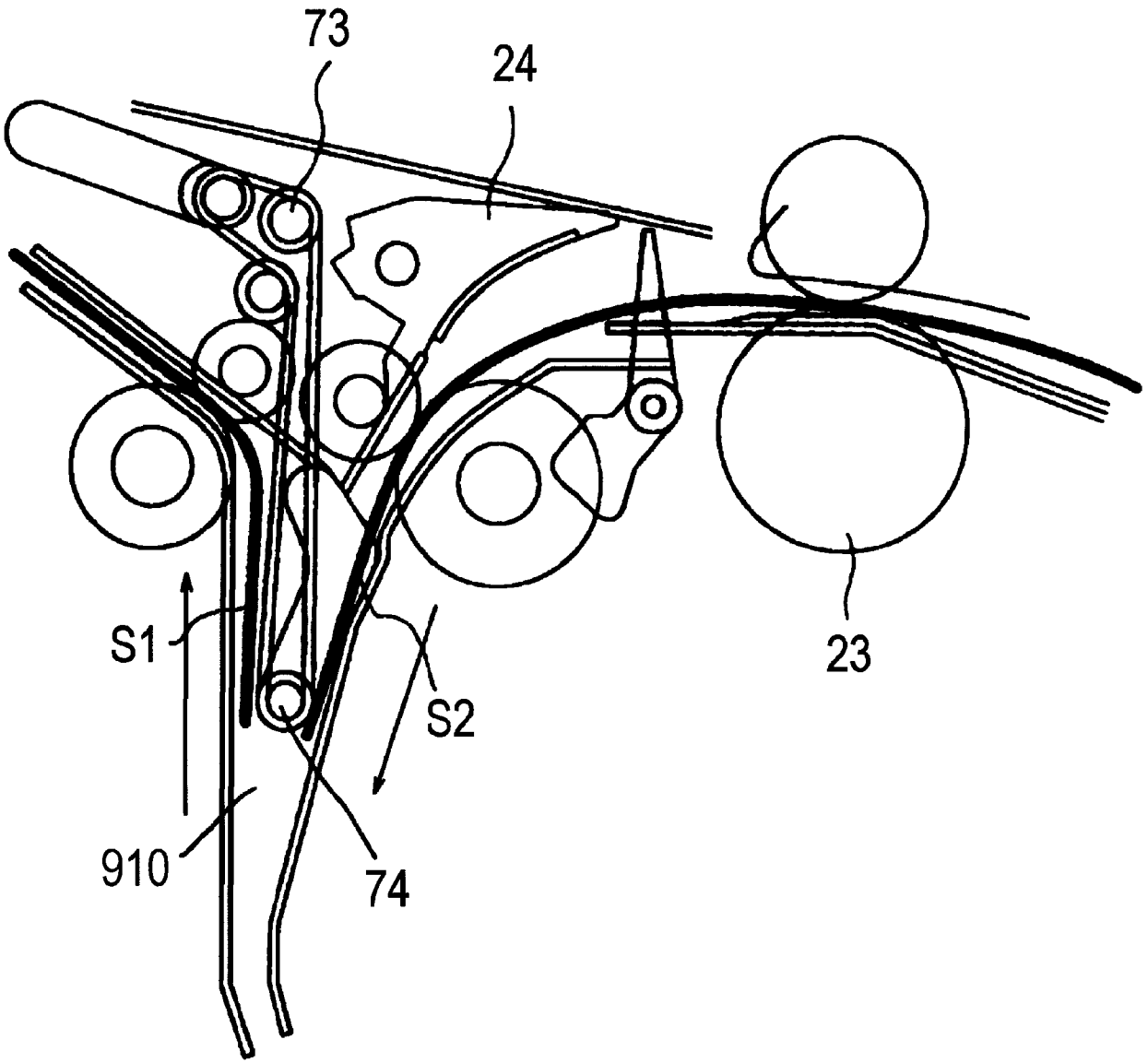
FIG. 9 is a cross-sectional view describing an operation of the sheet conveying apparatus illustrated in FIG. 2.
Figure 10:
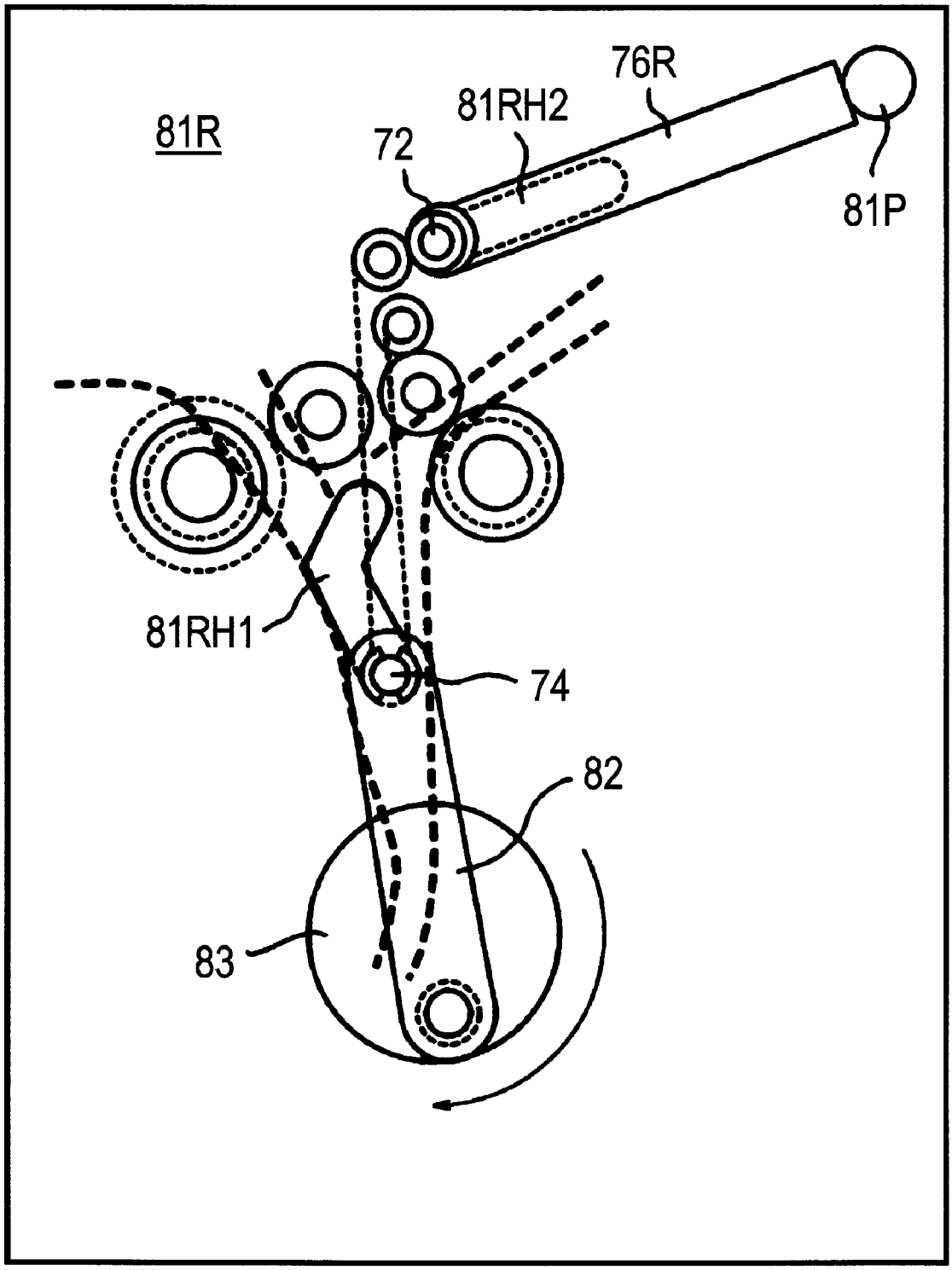
FIG. 10 is a cross-sectional view describing an operation of the sheet conveying apparatus illustrated in FIG. 2.

Then, the control unit 901 controls the stepping motor M to cause the movable shaft 74 to move to a third position illustrated in FIGS. 9 and 10, at timing at which the previous sheet S1 and a subsequent sheet S2 rub against each other. The movable shaft 74 is caused to return to the first position illustrated in FIGS. 5 and 6, during a period of time between when a trailing end of the previous sheet S1 being reversely conveyed passes through the junction location and when the subsequent sheet S2 ends a drawing operation. After the conveyance state in that the previous sheet S1 and the subsequent sheet S2 convey against each other on the junction location is finished, the movable shaft 74 is located at the first position. These movements are also performed by the drive gear 83 being rotated by the stepping motor M (not illustrated) by a predetermined step angle.

Figure 11:
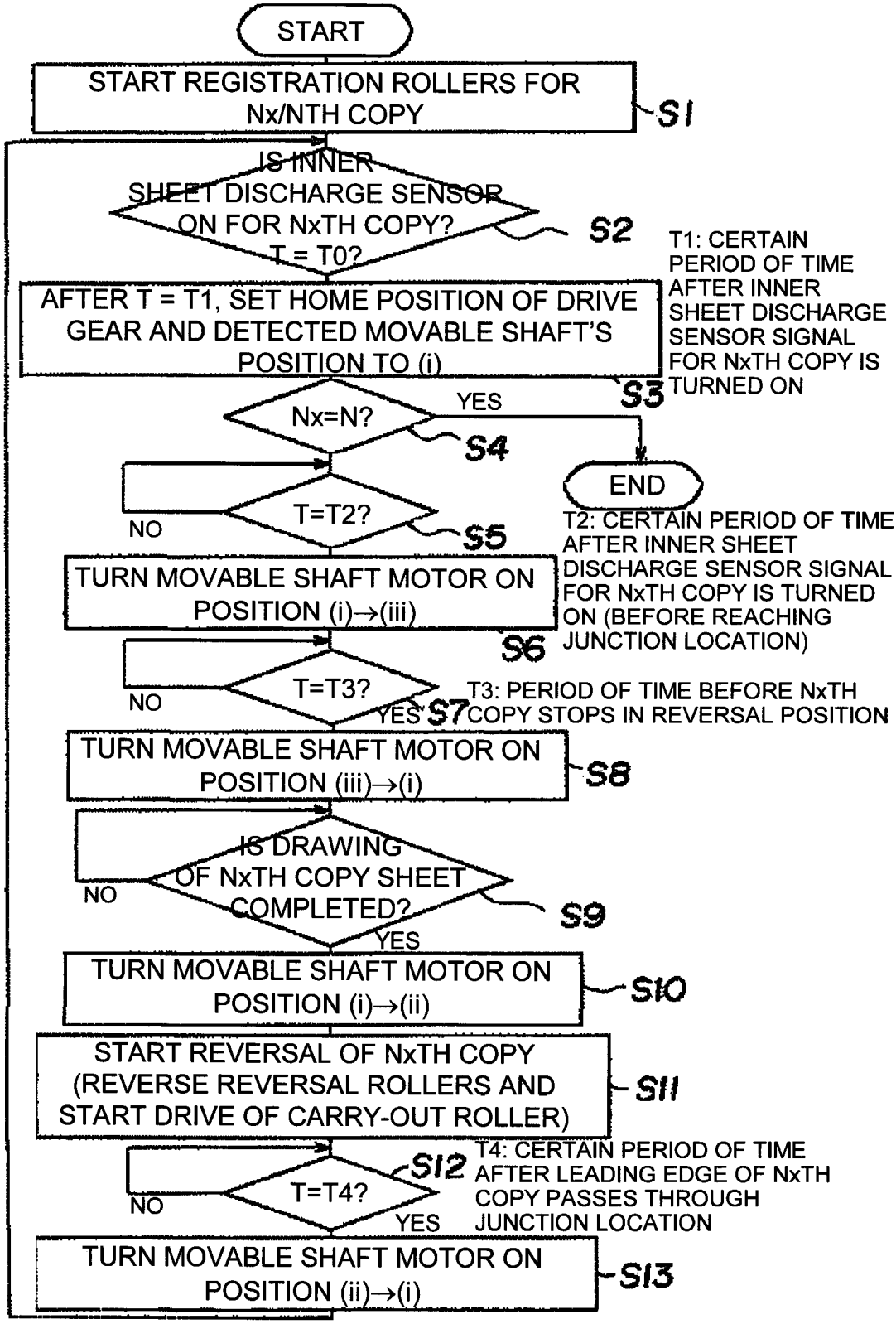
FIG. 11 is a flowchart describing a control method for the sheet conveying apparatus illustrated in FIG. 2.

Next, a control method for the sheet conveying apparatus will be described using a flowchart illustrated in FIG. 11.

A control method performed after conveyance of an Nxth copy by the pair of registration rollers 45 starts will be described (step S1). First, it is assumed that the timing at which the inner sheet discharge sensor 903 detects a leading end of an Nxth copy sheet is T=T0 (step S2). The control unit 901 controls the stepping motor M such that the positions of the drive gear 83 and the movable shaft 74 are accurately fixed in the first position illustrated in FIG. 5, during an adequate period of time (T=T1) before the leading end of the Nxth copy sheet reaches the junction location (step S3).

If the Nxth copy is the last one to be printed, then the process ends with the movable shafts 72 and 74 being positioned in the first position which is their home position. If there is a subsequent copy to be printed, then the process transitions to next control (step S4). If the control unit 901 determines that an adequate period of time (T=T2, T2>T1) before the leading end of the Nxth copy sheet reaches the junction location has come, then the process transitions to next control (step S5).

The control unit 901 drives the stepping motor M for moving movable shafts to cause the movable shafts 72 and 74 to move to the third position illustrated in FIG. 9. At this time, a previous sheet S1 (Nx−1th copy) and a subsequent sheet S2 (Nxth copy) are prevented from rubbing against each other (step S6).

If the control unit 901 determines that a predetermined period of time (T=T3) which is before completion of a drawing operation of the Nxth copy sheet S has come, then the process transitions to next control (step S7). The control unit 901 controls the stepping motor M to move the movable shaft 74 back to the first position illustrated in FIG. 5 so that the leading end of the Nxth copy sheet is securely led to a carry-out sheet conveying path 59 (step S8).

If the drawing operation of the Nxth copy is completed, then the process transitions to next control (step S9). The control unit 901 controls the stepping motor M to move the movable shaft 74 to the second position illustrated in FIG. 7. This securely prevents the sheet S from returning to a carry-in conveying path (step S10). Reversal conveyance is started by a carry-out roller 57 and the reversal roller 904 (step S11). The process transitions to next control after a lapse of a predetermined period of time (T=T4) from when the leading end of the Nxth copy sheet passes through the junction location (step S12). The control unit 901 controls the stepping motor M to move the movable shaft 74 back to the first position illustrated in FIG. 5 (step S13). Thereafter, the process returns to step S2.

As such, in the present embodiment, the movable shaft 74 is caused to move to the third position to split the reversal conveying path 910 into the first sheet conveying path 51 through which a subsequent sheet passes and the second sheet conveying path 54 through which a previous sheet passes, by the movable shaft 74 and the belts 71. That is, the movable shaft 74 and the belts 71 which serve as a branch position movable unit cause a branch position between the first sheet conveying path 51 and the second sheet conveying path 54 to move to the downstream side of the first sheet conveying path 51. Further, the movable shaft 74 moves to a position further than the third position from the reversal roller 904, before a drawing operation of a subsequent sheet S completes, i.e., before reversal conveyance of a subsequent sheet S starts. Consequently, while the intervals between sheets S to be continuously conveyed upon image formation are reduced, a previous sheet S1 and a subsequent sheet S2 can be prevented from rubbing against each other in the reversal conveying path 910.

In above described embodiment the movable shaft 74 and the belts 71 move to the third position after the reversal roller 904 starts to reversely convey the sheet. But the present invention is not limited the embodiment in which the movable shaft 74 and the belts 71 move to the third position after the reversal roller 904 starts to reversely convey the sheet. It can be constituted that after the trailing end of the sheet that is conveyed through the first sheet conveying path 51 passes the movable shaft 74, the movable shaft 74 and the belts 71 move to the third position.

In addition, by providing the rollers 74C which are coaxial with the movable shaft 74, rubbing of an image side of a sheet S can be prevented. Accordingly, continuous high-speed reversal conveyance of sheets can be implemented while excellent images are maintained.

Moreover, since the movable shaft 74 and the belts 71 move to a position where a sheet S is prevented from returning to the first sheet conveying path 51, even if the sheet S has low stiffness, returning of the sheet S is securely prevented.

Although the embodiment of the present invention is described in detail above, the present invention is not limited thereto and various changes may be made without departing from the spirit and scope of the invention as defined by the appended claims.

For example, although in the present embodiment the movable shaft 74 and the belts 71 are used as a splitting unit for the reversal conveying path 910, the present invention is not limited thereto, even when a sheet-metal guide member is movably configured, the same effects can be expected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-149456, filed Jun. 6, 2008, which is hereby incorporated by reference herein in its entirety.

What is claimed is:

1. A sheet conveying apparatus comprising:

a first conveying path through which a sheet is conveyed;

a first nip, provided on the first conveying path, which conveys a sheet in a first direction;

a reversal roller which, after conveying the sheet in a first direction, conveys the sheet in the second direction in opposite direction to the first direction;

a second conveying path which branches off with the first conveying path and through which the sheet reversely conveyed by the reversal roller is conveyed;

a second nip, provided on the second conveying path, which carries the sheet conveyed by the reversal roller to the second direction;

a movable unit which is disposed between the first nip and the reverse roller, and between the reverse roller and the second nip to allow the sheet, which is conveyed from the first nip to the reversal roller, to pass one side of the movable unit, and to allow the sheet, which is conveyed from the reversal roller to the second nip, to pass the other side of the movable unit;

a guide elongated along a conveying direction of the sheet which is conveyed through the first conveying path, which is configured to guide the movable unit along the conveying direction of the sheet;

a driving unit that moves the movable unit along the guide; and a controller configured to control the driving unit to move the movable unit toward the reversal roller along the conveying direction of the sheet, after a trailing end of the sheet which is conveyed through the first conveying path passes the movable unit, wherein the movable unit moved toward the reversal roller by the controller is between a previous sheet which is conveyed from the reversal roller to the second nip and subsequent sheet which is simultaneously conveyed from the first nip to the reversal roller so as to prevent the previous sheet from contacting to the subsequent sheet, when the first nip and the second nip simultaneously convey the previous sheet and the subsequent sheet, respectively.

2. The sheet conveying apparatus according to claim 1, wherein the controller controls the driving unit to move the movable unit toward the reversal roller, after the reversal roller starts to convey the sheet in the second direction.

3. The sheet conveying apparatus according to claim 1, wherein the movable unit is movable to a blocking position for preventing the sheet reversely conveyed by the reversal roller from returning to the first conveying path.

4. The sheet conveying apparatus according to claim 1, wherein the movable unit is provided with a movable shaft and a roller arranged on the movable shaft which rotates so that rubbing of the sheet can be prevented.

5. The sheet conveying apparatus according to claim 1, wherein the movable unit is movable to a first position used when a branch position between the first conveying path and the second conveying path is caused to move toward the reversal roller, and a second position further than the first position from the reversal roller in an upstream side of the first conveying path, and wherein the controller controls the driving unit to move the movable unit to the first position after the trailing edge of the previous sheet which is conveyed through the first conveying path passes the movable unit, and wherein the controller controls the driving unit to move the movable unit to the second position after the conveyance state in which the previous sheet and a subsequent sheet pass each other on the branch position is finished.

6. An image forming apparatus comprising:

a sheet conveying apparatus including:

a first conveying path through which a sheet is conveyed;

a first nip, provided on the first conveying path, which conveys a sheet in a first direction;

a reversal roller which, after conveying the sheet in a first direction, conveys the sheet in the second direction in opposite direction to the first direction;

a second conveying path which branches off with the first conveying path and through which the sheet reversely conveyed by the reversal roller is conveyed;

a second nip, provided on the second conveying path, which carries the sheet conveyed by the reversal roller to the second direction;

a movable unit which is disposed between the first nip and the reverse roller, and between the reverse roller and the second nip to allow the sheet, which is conveyed from the first nip to the reversal roller, to pass one side of the movable unit, and to allow the sheet, which is conveyed from the reversal roller, to the second nip, to pass the other side of the movable unit; a guide, elongated along a conveying direction of the sheet which is conveyed through the first conveying path, which is configured to guide the movable unit along the conveying direction of the sheet;

a driving unit that moves the movable unit along the guide; and a controller configured to control the driving unit to move the movable unit toward the reversal roller along the conveying direction of the sheet, after a trailing end of the sheet which is conveyed through the first conveying path passes the movable unit, wherein the movable unit moved toward the reversal roller by the controller is positioned between a previous sheet which is conveyed from the reversal roller to the second nip and a subsequent sheet which is simultaneously conveyed from the first nip to the reversal roller so as to prevent the previous sheet from contacting to the subsequent sheet, when the first nip and the second nip simultaneously convey the previous sheet and the subsequent sheet, respectively; and an image forming unit which forms an image on the sheet conveyed by the sheet conveying apparatus.

7. The image forming apparatus to claim 6, wherein the controller controls the driving unit to move the movable unit toward the reversal roller, after the reversal roller starts to convey the sheet in the second direction.

8. The image forming apparatus according to claim 6, wherein the movable unit is movable to a blocking position for preventing the sheet reversely conveyed by the reversal roller from returning to the first conveying path.

9. The image forming apparatus according to claim 6, wherein the movable unit is provided with a movable shaft and a roller arranged on the movable shaft which rotates so that rubbing of the sheet can be prevented.

10. The image forming apparatus according to claim 6, wherein the movable unit is movable to a first position used when the branch position between the first conveying path and the second conveying path is caused to move toward the reversal roller, and a second position further than the first position from the reversal roller in the upstream side of the first conveying path;

wherein the controller controls the driving unit to move the movable unit to the first position after the trailing edge of the previous sheet which is conveyed through the first conveying path passes the movable unit; and wherein the controller controls the driving unit to move the movable unit to the second position after the conveyance state in which the previous sheet and a subsequent sheet pass each other on the branch position is finished.

* * * * *